US010497525B2

(12) United States Patent
Makino

(10) Patent No.: US 10,497,525 B2
(45) Date of Patent: Dec. 3, 2019

(54) ELECTROMAGNETIC CONTACTOR

(71) Applicant: Mitsubishi Electric Corporation, Chiyoda-ku (JP)

(72) Inventor: Satoshi Makino, Tokyo (JP)

(73) Assignee: Mitsubishi Electric Corporation, Chiyoda-ku (JP)

( * ) Notice: Subject to any disclaimer, the term of this patent is extended or adjusted under 35 U.S.C. 154(b) by 0 days.

(21) Appl. No.: 15/741,791

(22) PCT Filed: Sep. 29, 2015

(86) PCT No.: PCT/JP2015/077544
§ 371 (c)(1),
(2) Date: Jan. 4, 2018

(87) PCT Pub. No.: WO2017/056195
PCT Pub. Date: Apr. 6, 2017

(65) Prior Publication Data

US 2018/0197708 A1 Jul. 12, 2018

(51) Int. Cl.
*H01H 9/30* (2006.01)
*H01H 50/54* (2006.01)
(Continued)

(52) U.S. Cl.
CPC ..... *H01H 50/541* (2013.01); *H01H 50/02* (2013.01); *H01H 50/08* (2013.01)

(58) Field of Classification Search
CPC ..... H01H 50/541; H01H 50/02; H01H 50/08
(Continued)

(56) References Cited

U.S. PATENT DOCUMENTS

2006/0219966 A1* 10/2006 Zecchi ..... G05D 16/0647 251/61.2
2010/0245002 A1* 9/2010 Watanabe ..... H01H 50/163 335/185

(Continued)

FOREIGN PATENT DOCUMENTS

CN 102725814 A 10/2012
CN 103946764 A 7/2014

(Continued)

OTHER PUBLICATIONS

International Search Report dated Dec. 22, 2015 in PCT/JP2015/077544, filed on Sep. 29, 2015.

(Continued)

*Primary Examiner* — Shawki S Ismail
*Assistant Examiner* — Lisa N Homza
(74) *Attorney, Agent, or Firm* — Oblon, McClelland, Maier & Neustadt, L.L.P.

(57) ABSTRACT

An electromagnetic contactor to open and close a contact formed by a movable contact and a fixed contact. The electromagnetic contactor includes an arc extinguishing cover having a shape in which a center portion is concaved with respect to an edge portion in a first direction and in which faces having a same height as the center portion continue in a second direction crossing the first direction; and an operation indicating piece arranged at an end of the movable contactor, to indicate a contact state of the contact by projecting from the center portion of the arc extinguishing cover or by being embedded therein. A step between the edge portion and the center portion of the arc extinguishing cover is equal to or larger than a projecting amount of the operation indicating piece that projects from the center portion of the arc extinguishing cover.

5 Claims, 10 Drawing Sheets

(51) Int. Cl.
*H01H 50/08* (2006.01)
*H01H 50/02* (2006.01)

(58) Field of Classification Search
USPC ..... 335/201
See application file for complete search history.

(56) References Cited

U.S. PATENT DOCUMENTS

2012/0133461 A1* 5/2012 Naka ..... H01H 50/323
335/157
2012/0249271 A1* 10/2012 Naka ..... H01H 50/04
335/202
2012/0280771 A1* 11/2012 Takaya ..... H01H 50/323
335/160
2013/0002381 A1* 1/2013 Takaya ..... H01H 50/323
335/157
2013/0076463 A1* 3/2013 Takaya ..... H01H 50/045
335/189
2013/0127570 A1* 5/2013 Naka ..... H01H 50/30
335/192
2013/0335175 A1* 12/2013 Tachikawa ..... H01H 1/54
335/147

FOREIGN PATENT DOCUMENTS

JP 49-063469 U1 6/1974
JP 57-070642 U1 4/1982
JP 04-033628 Y2 8/1992
JP 07-182959 A 7/1995
JP 2008-027656 A 2/2008

OTHER PUBLICATIONS

Combined Chinese Office Action and Search Report dated Jul. 25, 2019, in Patent Application No. 201580083391.0, 13 pages (with unedited computer generated English translation).

* cited by examiner

ELECTROMAGNETIC CONTACTOR

FIELD

The present invention relates to an electromagnetic contactor in which a circuit is cut off by a force of a returning spring by stopping excitation of an operating coil, thereby cutting off power supply to a load.

BACKGROUND

Patent Literature 1 discloses an electromagnetic contactor in which an end face in a moving direction of an outermost end in the moving direction of a movable-contactor support or an operation indicating piece that moves together with the movable-contactor support is located in the same plane as an outer face of an arc extinguishing cover when a movable contactor is at an open position. In the electromagnetic contactor disclosed in Patent Literature 1, a guide face of the arc extinguishing cover, which is invisible from outside of the electromagnetic contactor when the movable contactor is at the open position and is exposed to be a visible portion when the movable contactor is at a contact position, is colored with a different color from a background color of the arc extinguishing cover or is provided with a guide piece of the different color. In this manner, an operating state can be easily determined without causing the movable-contactor support or the operation indicating piece to project from the outer face of the arc extinguishing cover. In the electromagnetic contactor disclosed in Patent Literature 1, there is no need to cause the movable-contactor support or the operation indicating piece to project from a housing of a main body of the electromagnetic contactor for the purpose of the determination.

CITATION LIST

Patent Literature

Patent Literature 1: Japanese Patent Application Laid-open No. H7-182959

SUMMARY

Technical Problem

However, according to Patent Literature 1 described above, because the end face in the moving direction of the outermost end in the moving direction of the operation indicating piece that moves together with the movable-contactor support is arranged in the same plane as the outer face of the arc extinguishing cover, it is impossible to confirm the operation indicating piece and to confirm an operating indication unless the electromagnetic contactor is viewed obliquely.

The present invention has been achieved in view of the above problems, and an object of the present invention is to provide an electromagnetic contactor that enables an operating state to be confirmed without being viewed obliquely.

Solution to Problem

In order to solve the above problems and achieve the object, the present invention is an electromagnetic contactor moving a movable contactor by an electromagnetic force to open and close a contact formed by a movable contact included in the movable contactor and a fixed contact included in a fixed contactor fixed to a housing. The present invention includes an arc extinguishing cover having a shape in which a center portion is concaved with respect to an edge portion in a first direction and faces having a same height as the center portion are continuous with each other in a second direction crossing the first direction, to cover the contact. The present invention further includes an operation indicating piece arranged at an end of the movable contactor, to indicate a contact state of the contact by projecting from the center portion of the arc extinguishing cover when the contact is off and by being embedded in the center portion of the arc extinguishing cover when the contact is on. In the present invention, a step between the edge portion and the center portion of the arc extinguishing cover is equal to or larger than a projecting amount of the operation indicating piece that projects from the center portion of the arc extinguishing cover when the contact is off.

Advantageous Effects of Invention

The electromagnetic contactor according to the present invention provides an effect of enabling an operation state to be confirmed without being viewed obliquely.

DESCRIPTION OF EMBODIMENTS

An electromagnetic contact according to an embodiment of the present invention will be described in detail below with reference to the accompanying drawings. The present invention is not limited to the embodiment.

Embodiment

Figure 1:
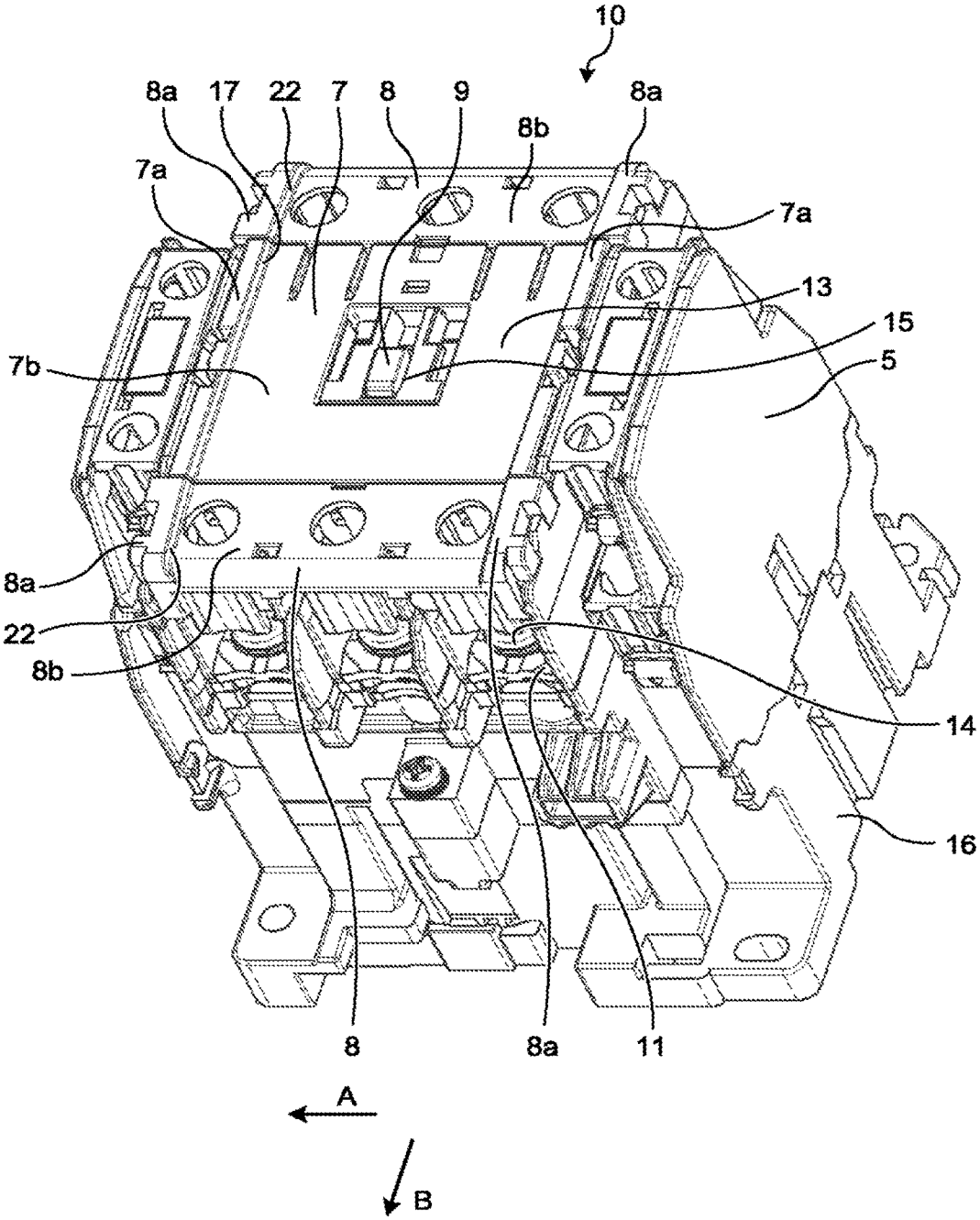
FIG. 1 is a perspective view of an electromagnetic contactor according to an embodiment of the present invention.
Figure 2:
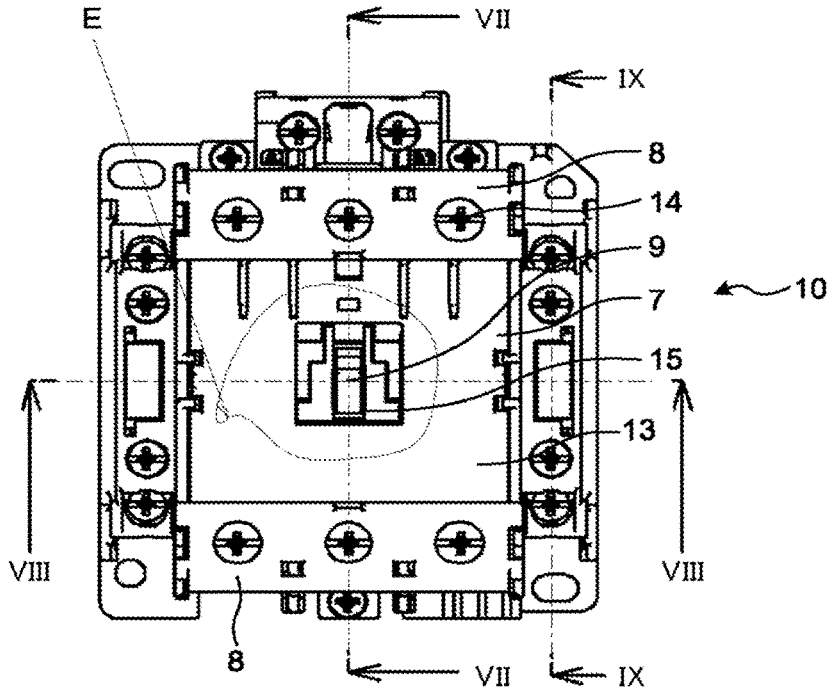
FIG. 2 is a front view of the electromagnetic contactor according to the embodiment.
Figure 3:
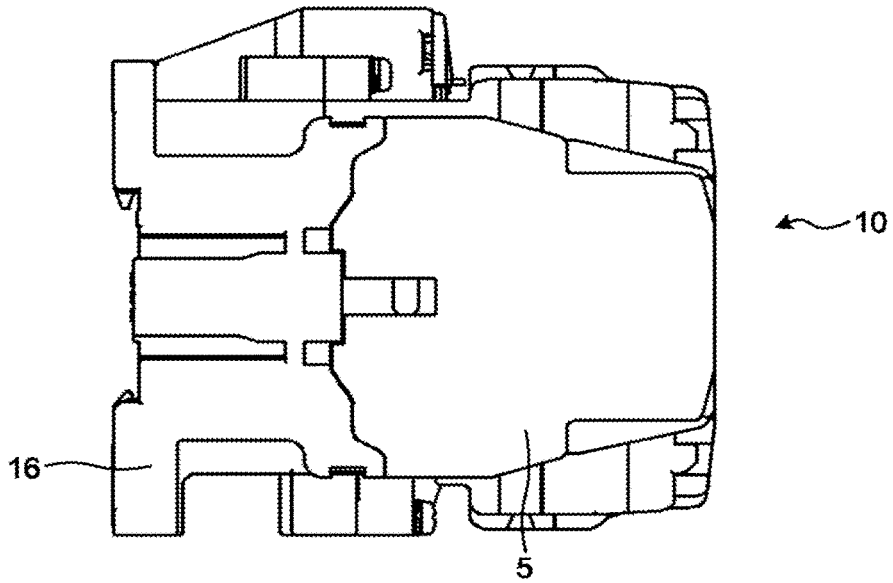
FIG. 3 is a left side view of the electromagnetic contactor according to the embodiment.
Figure 4:
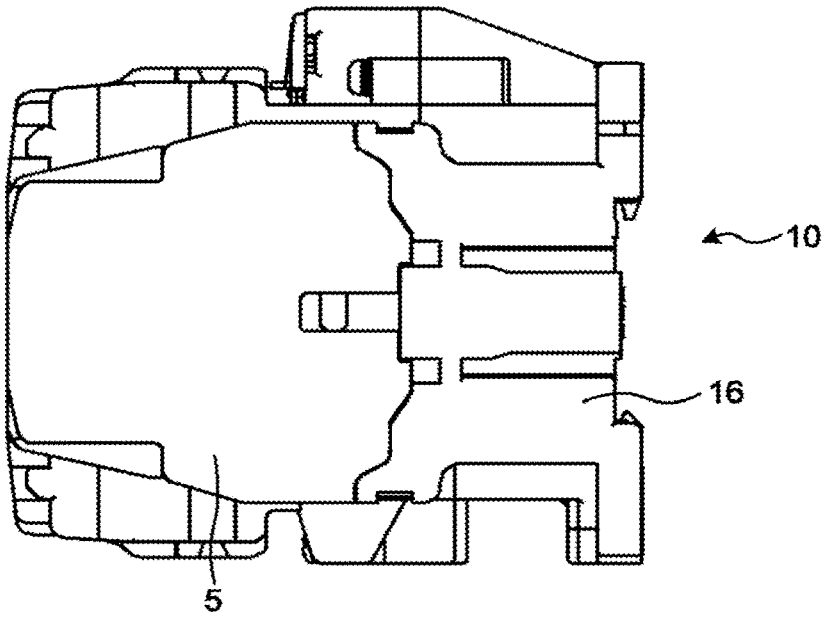
FIG. 4 is a right side view of the electromagnetic contactor according to the embodiment.
Figure 5:
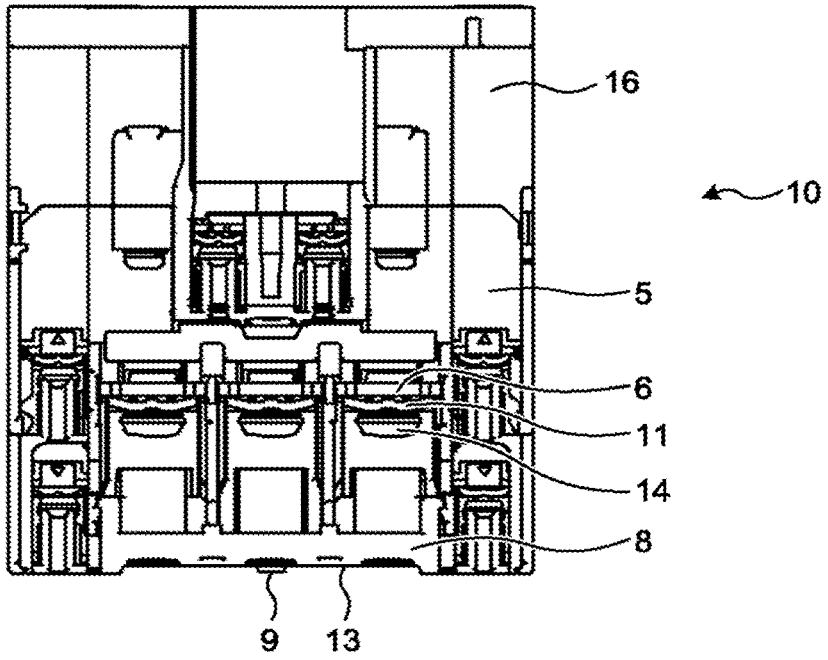
FIG. 5 is a top view of the electromagnetic contactor according to the embodiment.
Figure 6:
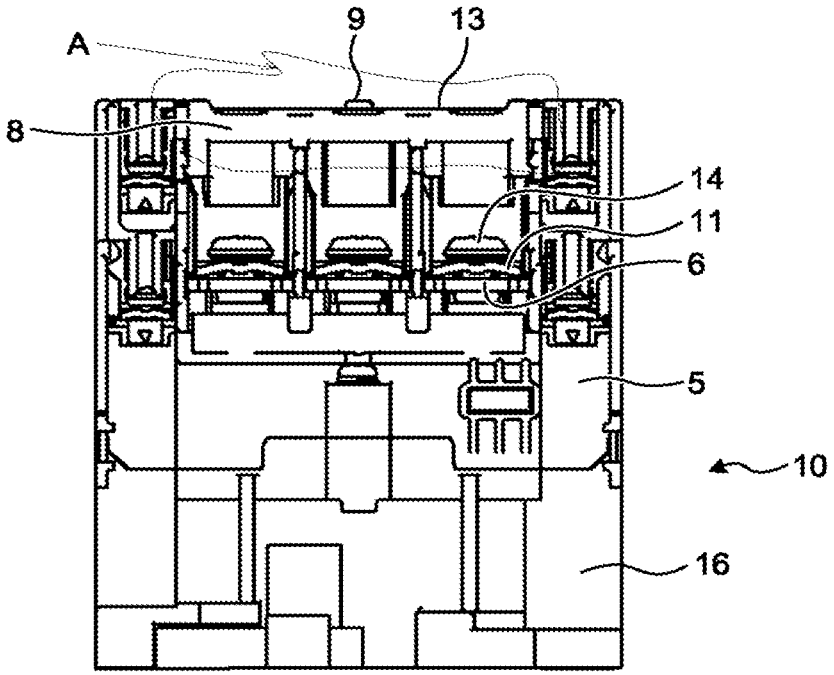
FIG. 6 is a bottom view of the electromagnetic contactor according to the embodiment.
Figure 7:
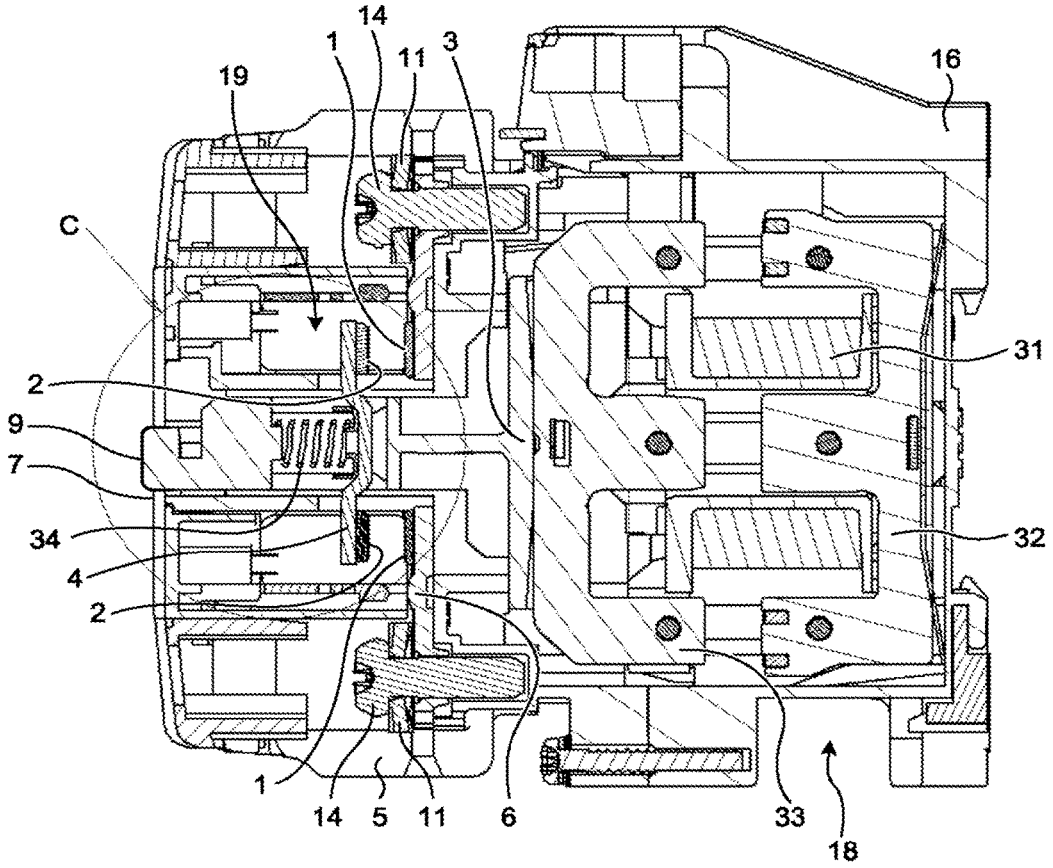
FIG. 7 is a cross-sectional view of the electromagnetic contactor according to the embodiment.
Figure 8:
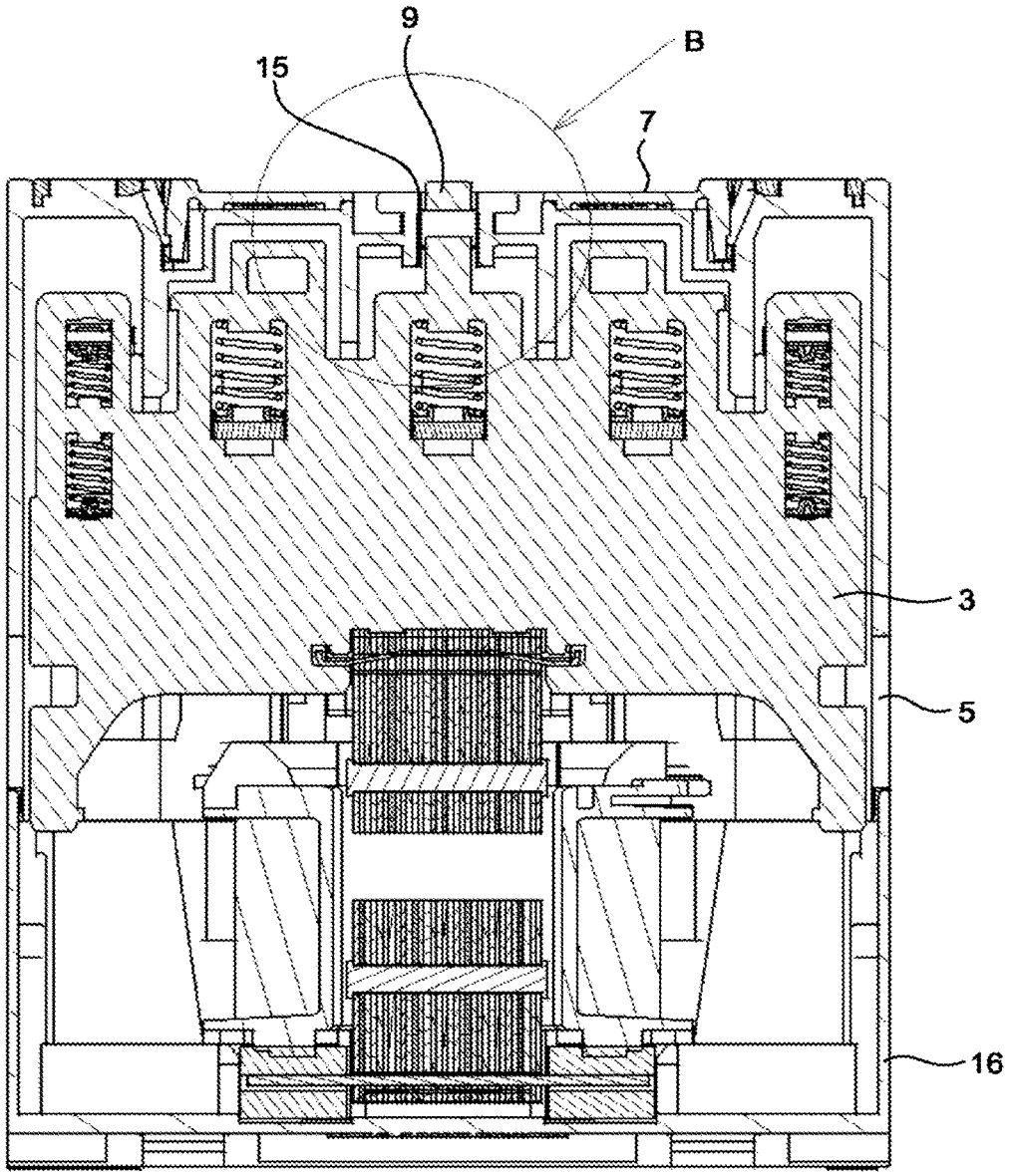
FIG. 8 is a cross-sectional view of the electromagnetic contactor according to the embodiment.
Figure 9:
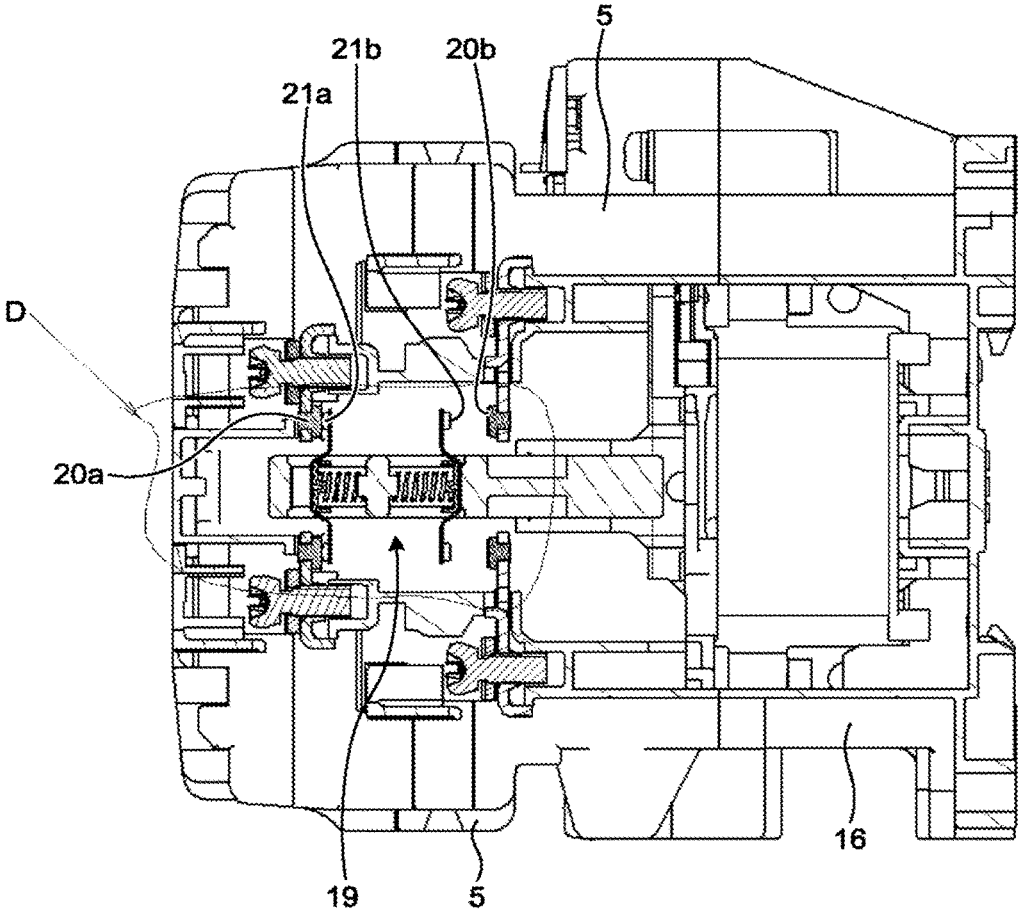
FIG. 9 is a cross-sectional view of the electromagnetic contactor according to the embodiment.
Figure 10:
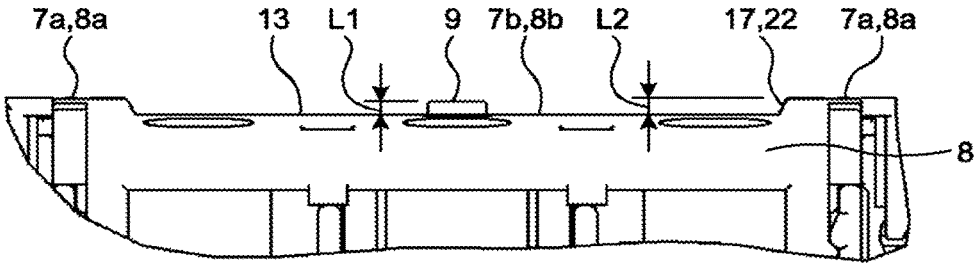
FIG. 10 is a partially enlarged view of the electromagnetic contactor according to the embodiment.
Figure 11:
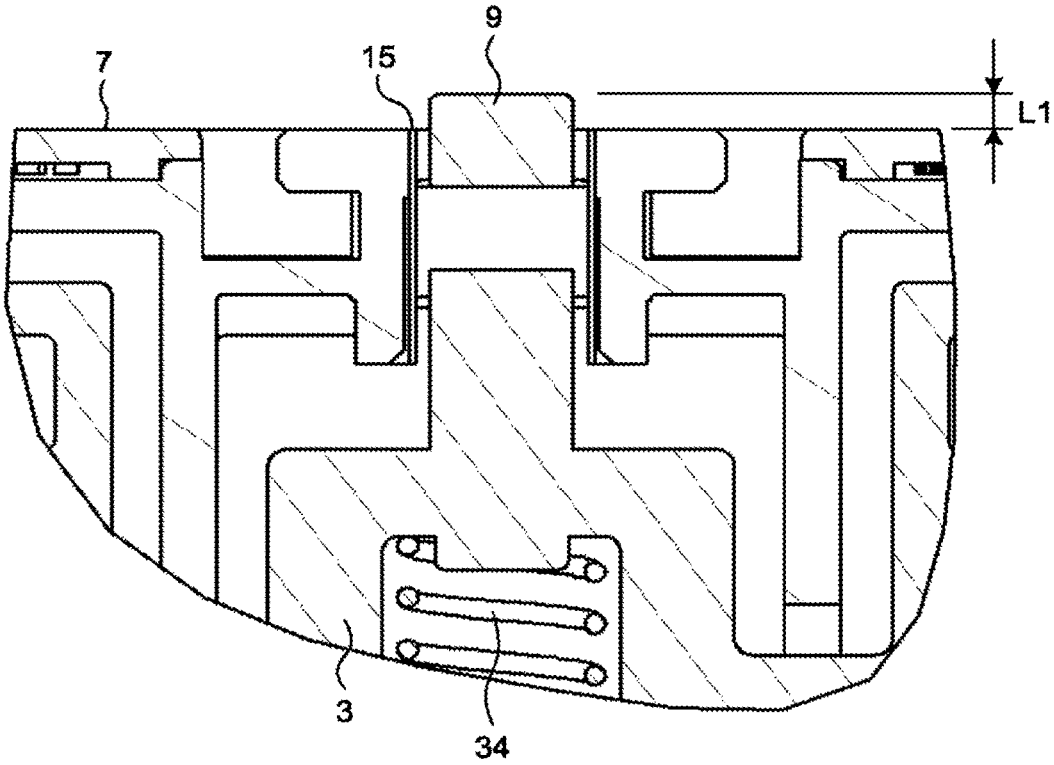
FIG. 11 is a partially enlarged view of the electromagnetic contactor according to the embodiment.
Figure 12:
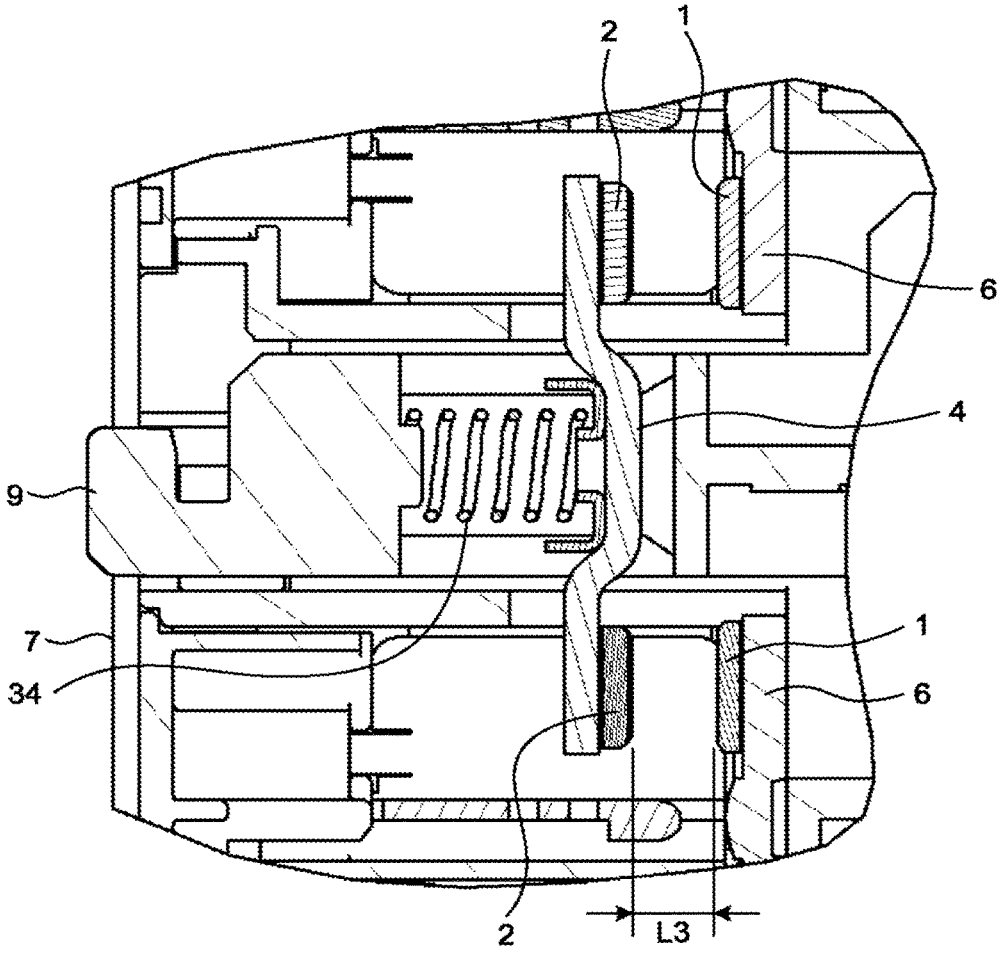
FIG. 12 is a partially enlarged view of the electromagnetic contactor according to the embodiment.
Figure 13:
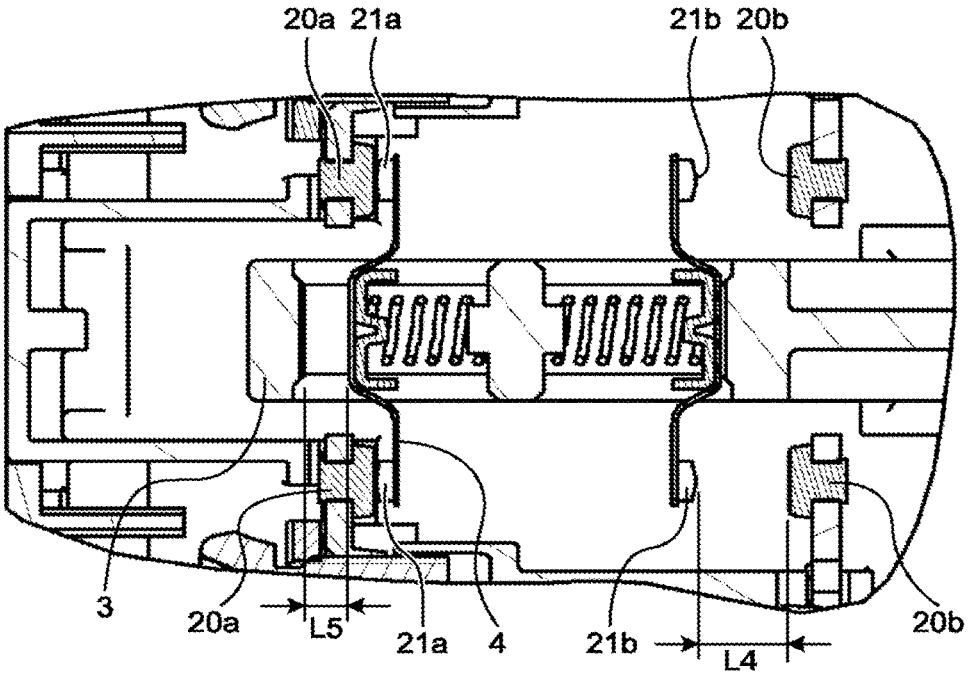
FIG. 13 is a partially enlarged view of the electromagnetic contactor according to the embodiment.
Figure 14:
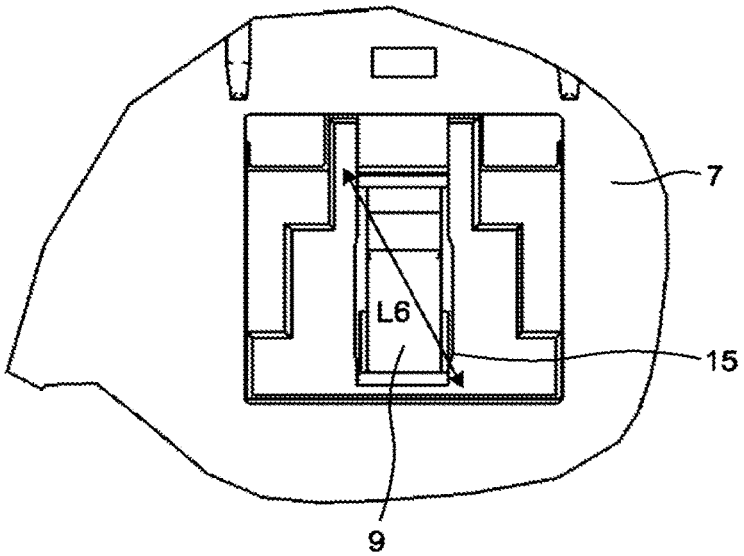
FIG. 14 is a partially enlarged view of the electromagnetic contactor according to the embodiment.

FIG. 1 is a perspective view of an electromagnetic contactor according to an embodiment of the present invention. FIG. 2 is a front view of the electromagnetic contactor according to the embodiment. FIG. 3 is a left side view of the electromagnetic contactor according to the embodiment. FIG. 4 is a right side view of the electromagnetic contactor according to the embodiment. FIG. 5 is a top view of the electromagnetic contactor according to the embodiment. FIG. 6 is a bottom view of the electromagnetic contactor according to the embodiment. FIG. 7 is a cross-sectional view of the electromagnetic contactor according to the embodiment, taken along a line VII-VII in FIG. 2. FIG. 8 is a cross-sectional view of the electromagnetic contactor according to the embodiment, taken along a line VIII-VIII in FIG. 2. FIG. 9 is a cross-sectional view of the electromagnetic contactor according to the embodiment, taken along a line IX-IX in FIG. 2. FIG. 10 is a partially enlarged view of the electromagnetic contactor according to the embodiment, illustrating a portion A in FIG. 6. FIG. 11 is a partially enlarged view of the electromagnetic contactor according to the embodiment, illustrating a portion B in FIG. 8. FIG. 12 is a partially enlarged view of the electromagnetic contactor according to the embodiment, illustrating a portion C in FIG. 7. FIG. 13 is a partially enlarged view of the electromagnetic contactor according to the embodiment, illustrating a portion D in FIG. 9. FIG. 14 is a partially enlarged view of the electromagnetic contactor according to the embodiment, illustrating a portion E in FIG. 2.

As illustrated in FIGS. 1 to 9, an electromagnetic contactor 10 includes an electromagnet unit 18 that includes a movable iron core 33 accommodated to be movable in a rear case 16 and a fixed iron core 32 fixed to the rear case 16 and drawing the movable iron core 33 by a magnetic force when an operating coil 31 is excited, and an opening and closing unit 19 that includes a fixed contact 1, a movable contact 2, and a return spring 34 for switching on and off a load current. To the movable iron core 33, a movable-contactor support 3 that supports a movable contactor 4 is coupled. The movable contactor 4 includes the movable contact 2. In a housing 5, a fixed contactor 6 including the fixed contact 1 is incorporated. The fixed contact 1 and the movable contact 2 form a pair serving as one contact. The fixed contactor 6 includes a terminal 11 for connecting a wire to the fixed contactor 6 with a terminal screw 14. The terminal 11 is covered by a terminal cover 8.

An arc extinguishing cover 7 has a shape in which a center portion 7*b* is concaved with respect to an edge portion 7*a* in a first direction indicated with an arrow A in FIG. 1 and faces having the same height as the center portion 7*b* are continuous with each other to form a step bottom face 13 in a second direction indicated with an arrow B in FIG. 1 which crosses the first direction. In the embodiment, the first direction indicated with the arrow A and the second direction indicated with the arrow B are perpendicular to each other. The arc extinguishing cover 7 is an arc extinguishing mechanism that covers the fixed contact 1 and the movable contact 2. The arc extinguishing cover 7 includes a square hole 15.

The terminal cover 8 has a shape having a terminal-cover edge portion 8*a* continuous with the edge portion 7*a* and a terminal-cover center portion 8*b* continuous with the center portion 7*b*.

Because the terminal cover 8 has a shape having the terminal-cover edge portion 8*a* continuous with the edge portion 7*a* and the terminal-cover center portion 8*b* continuous with the center portion 7*b*, a step 17 between the edge portion 7*a* and the center portion 7*b* and a step 22 between the terminal-cover edge portion 8*a* and the terminal-cover center portion 8*b* are continuous with each other in a side portion of the electromagnetic contactor 10.

When the operating coil 31 illustrated in FIG. 7 is not excited, the fixed contact 1 and the movable contact 2 are separated from each other by the return spring 34, so that the electromagnetic contactor 10 is in an off-state where no current flows therethrough. FIGS. 1 to 14 illustrate a configuration of the electromagnetic contactor 10 in the off-state.

When the operating coil 31 is excited, the movable iron core 33 is drawn to the fixed iron core 32 and the movable contact 2 comes into contact with the fixed contact 1 in association with movement of the movable iron core 33 to close a circuit, so that the electromagnetic contactor 10 is placed in an on-state where current flows therethrough. When excitation of the operating coil 31 is released, the movable iron core 33 is separated from the fixed iron core 32 by the return spring 34, and the movable contact 2 is separated from the fixed contact 1 to cut off the load current. In this manner, the electromagnetic contactor 10 returns to the off-state.

As illustrated in FIG. 9, the opening and closing unit 19 includes an auxiliary fixed contact 20*a* and an auxiliary movable contact 21*a* that become conductive when the electromagnetic contactor 10 is in the off-state and are disconnected from each other when the electromagnetic contactor 10 is in the on-state, and an auxiliary fixed contact 20*b* and an auxiliary movable contact 21*b* that are disconnected from each other when the electromagnetic contactor 10 is in the off-state and become conductive when the electromagnetic contactor 10 is in the on-state.

When the electromagnetic contactor 10 is in the off-state, a tip portion 9 of the movable-contactor support 3 projects from the step bottom face 13 through the square hole 15 of the arc extinguishing cover 7. In the electromagnetic contactor 10 in the off-state, other components facing the tip portion 9 of the movable-contactor support 3 are not located in directions other than both side faces and a bottom face. Therefore, the off-state of the electromagnetic contactor 10 can be easily recognized from a top side and a bottom side. That is, it is possible to easily recognize the off-state of the electromagnetic contactor 10 from a viewing direction in FIGS. 5 and 6.

Further, when the electromagnetic contactor 10 is in the on-state, the tip portion 9 of the movable-contactor support 3 is drawn into the arc extinguishing cover 7, so that the tip portion 9 become invisible. Therefore, it is possible to easily recognize that the electromagnetic contactor 10 is in the on-state from the top side and the bottom side, and an operating state of the electromagnetic contactor 10 can be easily confirmed.

When the tip portion 9 of the movable-contactor support 3 projects from the step bottom face 13, a shadow appears around the tip portion 9 of the movable-contactor support 3 when the electromagnetic contactor 10 is viewed from its front. Meanwhile, when the tip portion 9 of the movable-contactor support 3 is embedded in the step bottom face 13, no shadow appears around the tip portion 9 of the movable-contactor support 3. Therefore, the operating state of the electromagnetic contactor 10 can be also confirmed from a front side easily.

That is, the operating state of the electromagnetic contactor 10 can be confirmed from the front side, the top side, and the bottom side without being viewed obliquely.

As described above, the movable-contactor support 3 projects from the step bottom face 13 when the electromagnetic contactor 10 is in an off-state and the contact is off, and is embedded in the step bottom face 13 when the electromagnetic contactor 10 is in an on-state and the contact is on, thereby serving as an operation indicating piece that indicates a state of the fixed contact 1 and the movable contact 2.

As illustrated in FIGS. 10 and 11, a projecting amount L1 of the tip portion 9 of the movable-contactor support 3 when the electromagnetic contactor 10 is in the off-state is equal to or less than a size L2 of the step 17 located in the side portion of the electromagnetic contactor 10 away from the tip portion 9 of the movable-contactor support 3. That is, the step 17 between the edge portion 7*a* and the center portion 7*b* of the arc extinguishing cover 7 has a height equal to or larger than the projecting amount L1 of the tip portion 9 of the movable-contactor support 3 from the step bottom face 13 when the electromagnetic contactor 10 is in the off-state.

Further, a dimensional relation represented by the following expression (1) is established among the projecting amount L1 of the tip portion 9 of the movable-contactor support 3 from the step bottom face 13 of the arc extinguishing cover 7, a size L3 of a gap between the fixed contact 1 and the movable contact 2 illustrated in FIG. 12, a size L4 of a gap between the auxiliary fixed contact 20*b* and the auxiliary movable contact 21*b* illustrated in FIG. 13, and a size L5 of a contact over-travel that is a moving amount of the movable contactor 4 from a point where the auxiliary movable contact 21*a* illustrated in FIG. 13 is brought to contact with the auxiliary fixed contact 20*a* until the auxiliary movable contact 21*a* completely presses the auxiliary fixed contact 20*a*. It can be also said that, as illustrated in FIG. 13, the contact over-travel is a moving amount of the movable contactor 4 from the point where the auxiliary movable contact 21*a* is brought to contact with the auxiliary fixed contact 20*a* until the movable contactor 4 abuts on the movable-contactor support 3.

$$L1<L5\leq L3=L4 \quad (1)$$

In a case where the contact over-travel is insufficient, a pressure against the auxiliary fixed contact 20*a* that is determined by the moving amount of the movable contactor 4 from the point where the auxiliary movable contact 21*a* is brought to contact with the auxiliary fixed contact 20*a* until the auxiliary movable contact 21*a* completely presses the auxiliary fixed contact 20*a* is reduced, resulting in insufficiency of a force that suppresses an electromagnetic repulsive force generated by flowing current. Chattering in which the contact rises up because of extraneous vibration is also likely to occur. Therefore, contact abnormal wear and contact welding caused by generation of arc between the auxiliary fixed contact 20*a* and the auxiliary movable contact 21*a* can easily occur because of contact malfunction and the rising of the contact, which lead to loss of a function of the electromagnetic contactor 10. Similarly, when the movable contact 2 and the fixed contact 1 is easily brought to contact with each other, the same phenomenon as that described above occurs.

As illustrated in FIG. 1, by providing the step 22 also in the terminal cover 8, the terminal-cover center portion 8*b* can be arranged in the same plane as the step bottom face 13. Therefore, the step bottom face 13 and the terminal-cover center portion 8*b* can be regarded as a continuous face. Accordingly, it is possible to print information on both the step bottom face 13 and the terminal cover 8 continuously or to arrange an option unit having such a size that the option unit projects from the step bottom face 13 to the terminal-cover center portion 8*b*, on the step bottom face 13.

When an object of which the size is equal to or smaller than the range of the step bottom face 13 and larger than the square hole 15 is used, it is easy to mechanically press the movable-contactor support 3. Furthermore, the movable contact 2 and the fixed contact 1 are not brought to contact with each other and the contact over-travel is not eliminated. Therefore, movement of the movable-contactor support 3 can be confirmed with safety, so that maintenance can be performed easily.

In addition, as illustrated in FIG. 14, a diagonal dimension L6 of the square hole 15 through which the tip portion 9 of the movable-contactor support 3 projects is smaller than the size of a human finger. When the square hole 15 is designed to have a diagonal dimension of 12.5 millimeters or less, the degree of protection against an external solid body corresponds to international protection rating 2 of IEC60529 that is one standard of IEC (International Electrotechnical Commission). By preventing a human finger from entering to the square hole 15, it is possible to limit the amount by which the movable-contactor support 3 is manually pressed, so that an erroneous operation of the electromagnetic contactor 10 caused by contact of the contact and insufficiency of the contact over-travel can be avoided.

As described above, in the electromagnetic contactor 10 according to the embodiment, even in a case where a control panel is arranged in a front portion of the electromagnetic contactor 10, the control panel abuts on a top surface of a step located in the side portion of the electromagnetic contactor 10. Therefore, the tip portion 9 of the movable-contactor support 3 does not abut on the control panel, so that the off-state of the electromagnetic contactor 10 is maintained. Accordingly, the function of the electromagnetic contactor 10 is not impaired. Therefore, it is not necessary to provide a gap between the tip portion 9 of the movable-contactor support 3 and the control panel, so that size reduction of the control panel using the electromagnetic contactor 10 can be achieved.

The configurations described in the above embodiment are only examples of the content of the present invention. The configurations can be combined with other well-known techniques, and a part of each configuration can be omitted or modified without departing from the scope of the present invention.

REFERENCE SIGNS LIST

1 fixed contact, 2 movable contact, 3 movable-contactor support, 4 movable contactor, 5 housing, 6 fixed contactor, 7 arc extinguishing cover, 7*a* edge portion, 7*b* center portion, 8 terminal cover, 8*a* terminal-cover edge portion, 8*b* terminal-cover center portion, 9 tip portion, 10 electromagnetic contactor, 11 terminal, 13 step bottom face, 14 terminal screw, 15 square hole, 16 rear case, 17, 22 step, 18 electromagnet unit, 19 opening and closing unit, 20*a*, 20*b* auxiliary fixed contact, 21*a*, 21*b* auxiliary movable contact, 31 operating coil, 32 fixed iron core, 33 movable iron core, 34 return spring.

The invention claimed is:

1. An electromagnetic contactor moving a movable contactor by an electromagnetic force to open and close a contact formed by a movable contact included in the movable contactor and a fixed contact included in a fixed contactor fixed to a housing, the electromagnetic contactor comprising:

an arc extinguishing cover, to cover the contact, configured to have a shape in which a center portion is concaved with respect to an edge portion in a first direction and in which faces having a same height as the center portion continue in a second direction crossing the first direction; and an operation indicating piece arranged at an end of the movable contactor, to indicate a contact state of the contact by projecting from the center portion of the arc extinguishing cover when the contact is off and by being embedded in the center portion of the arc extinguishing cover when the contact is on, wherein a step between the edge portion and the center portion of the arc extinguishing cover is equal to or larger than a projecting amount of the operation indicating piece that projects from the center portion of the arc extinguishing cover past an upper surface level of the center portion of the arc extinguishing cover when the contact is off.

2. The electromagnetic contactor according to claim 1, further comprising an auxiliary fixed contact and an auxiliary movable contact that become conductive when the contact is off and are disconnected from each other when the contact is on, wherein the projecting amount of the operation indicating piece that projects from the center portion of the arc extinguishing cover when the contact is off is equal to or smaller than an over-travel that is a pressing amount from start of contact between the auxiliary movable contact and the auxiliary fixed contact until the auxiliary movable contact completely presses the auxiliary fixed contact.

3. The electromagnetic contactor according to claim 1, wherein the projecting amount of the operation indicating piece that projects from the center portion of the arc extinguishing cover when the contact is off is equal to or smaller than a gap between the movable contact and the fixed contact.

4. The electromagnetic contactor according to claim 1, further comprising a terminal cover to cover a terminal for connecting a wire to the fixed contactor, wherein the terminal cover has a shape including a terminal-cover edge portion continuous with the edge portion and a terminal-cover center portion continuous with the center portion.

5. The electromagnetic contactor according to claim 1, wherein the arc extinguishing cover has an aperture through which the operation indicating piece projects when the contact is off.

* * * * *